US005635065A

United States Patent [19]

Spyra

[11] Patent Number: 5,635,065

[45] Date of Patent: Jun. 3, 1997

[54] SHAVINGS CENTRIFUGE

[76] Inventor: Thomas Spyra, Richard-Wagner Str. 5, D-71332 Waiblingen, Germany

[21] Appl. No.: 551,411

[22] Filed: Nov. 1, 1995

[30] Foreign Application Priority Data

Nov. 1, 1994 [DE] Germany ..... 9417273 U

[51] Int. Cl.[6] ..... B04B 7/00

[52] U.S. Cl. ..... 210/377; 210/378; 494/36; 494/60; 494/67

[58] Field of Search ..... 210/377, 388, 210/534; 494/36, 60, 67

[56] References Cited

U.S. PATENT DOCUMENTS

| | | | |
|---|---|---|---|
| 3,136,722 | 6/1964 | Gooch . | |
| 3,463,316 | 8/1969 | Fierstine . | |
| 4,122,014 | 10/1978 | Weininger et al. | 210/377 |
| 4,298,476 | 11/1981 | Dudley | 210/377 |
| 4,772,380 | 9/1988 | Cramer et al. | 210/534 |
| 5,372,571 | 12/1994 | Knelson et al. | 210/377 |

FOREIGN PATENT DOCUMENTS

| | | |
|---|---|---|
| 196638 | 10/1986 | European Pat. Off. . |
| 689951 | 4/1940 | Germany . |
| 1432886 | 3/1964 | Germany . |
| 8908470 | 7/1989 | Germany . |
| 9304723 | 9/1993 | Germany . |
| 312160 | 2/1956 | Switzerland . |

*Primary Examiner*—David A. Reifsnyder
*Attorney, Agent, or Firm*—Evenson, McKeown, Edwards & Lenahan P.L.L.C.

[57] ABSTRACT

A centrifuge for separating liquids and solids from various materials, including a rotatably driven receiving drum with a raisable and lowerable lift bottom arranged in a liquid-tight basin, and raisable and lowerable material guide surfaces arranged to be raised or lowered independently of the lift bottom.

15 Claims, 3 Drawing Sheets

SHAVINGS CENTRIFUGE

BACKGROUND OF THE INVENTION

This invention relates to a shavings centrifuge or pusher centrifuge for separating solids and/or liquids from various materials, such as shavings from metalworking operations, which centrifuge comprises a liquid-tight basin having a rotatable receiving drum arranged therein which is equipped with a lift bottom and a movable material guide surface, wherein the lift bottom and the material guide surface are displaceable longitudinally along the axis of the receiving drum.

A shavings centrifuge is known, for example, from German Utility Model No. DE-U 89-08,470 and serves for separating solids and liquids from materials. The known centrifuge comprises a machine frame mounted in a fixed position, a feeder funnel connected therewith, and a solid material discharge, as well as a liquid discharge and a cylindrical receiver housing for a receiver drum and a liquid-tight cylindrical basin. The rotationally driven receiving drum, which is equipped with a raisable and lowerable lift bottom, is disposed in this basin.

The advantage of such a lift bottom centrifuge is a better separation of solids and liquids and a continuous throughput of the material. Besides this advantage, however, such centrifuges can also have disadvantages. During centrifugation, it can occur that elongated materials, such as, for example, rods, flaps or felts, enter the centrifuge. The lift bottom of the centrifuge is connected with the material guide surfaces by pins. Under some circumstances, these materials can catch or hang up on these pins, and this can lead to clogs in the centrifuge, and thereby to disturbances and/or interruptions in the operation of the centrifuge.

SUMMARY OF THE INVENTION

The object of the invention is to provide a centrifuge which assures undisturbed operation in the processing of a great variety of materials.

Another object of the invention is to provide a centrifuge which is durable and requires a low amount of maintenance.

These and other objects have been achieved in accordance with the present invention by providing a shavings centrifuge for the separation of solids or liquids from various materials, comprising a liquid-tight basin in which a rotatable receiving drum is arranged, the receiving drum being provided with a lift bottom and a material guide surface which are displaceable longitudinally of the receiving drum, wherein said lift bottom and said material guide surface are each displaceable independently of the other.

A centrifuge according to the invention, whose lift bottom and material guide surfaces can execute raising and lowering movements, i.e. an up and down movement, separately from each other, and which are driven separately from each other, exhibits various advantages. If materials such as rods, flaps and/or felts are centrifuged, these materials do not cause any clogs, disturbances or stopping of the centrifuge. Since no connecting pins are required between the lift bottom and the material guide surfaces, the passageway for the material to be centrifuged is not interrupted. Consequently, no pieces can catch or hang up on any pins.

The operation of the centrifuge is completely automated; manual emptying is avoided. Thus, high personnel costs are saved. The operating life of the centrifuge is significantly prolonged. Wear and damage are reduced. Repair costs and material costs are saved.

In one embodiment of the centrifuge, a suction nozzle is provided for vacuuming up residual material. This extends into the receiving drum, and in an advantageous embodiment the nozzle is arranged to be longitudinally displaceable. This longitudinal displacement can be effected through an adjustable drive. In addition to the nozzle, the vacuum system further comprises a blower as well as a solid/liquid separator.

In accordance with one advantageous embodiment, a distributor is arranged adjacent the material guide surface. This distributor serves to distribute the stream of introduced material uniformly over the entire extent of the receiving drum. This distributor can be pivotally mounted in order to optimally distribute specific types of material. However, it can also be fixedly arranged on the material guide surface. In which case, this manner of attachment is especially suitable for certain sorts of materials.

A further development of the invention envisions equipping the receiving drum, which usually is provided with a shield ring, with a sieve. The use of such a sieve has the advantage that the feed material is demoisturized upon entry and the moisture or liquid can be rapidly removed.

The pan or basin, which is provided with a discharge for the centrifuged liquid, also can be provided in an advantageous manner with a rinsing liquid inlet. This makes it possible to clean the basin at preselected time intervals. By arranging the rinsing liquid inlet tangentially to the basin, a cleaning effect is produced which washes the entire inner surface of the basin with cleaning liquid and assures a uniform cleaning.

In a further advantageous embodiment of the invention, the lift bottom is mounted on a plurality of guide rods. Preferably at least three guide rods are provided. In this way, the lift bottom is effectively prevented from tipping or jamming as it moves.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments depicted in the accompanying drawings in which.

DETAILED DESCRIPTION OF PREFERRED EMBODIMENTS

Figure 1:
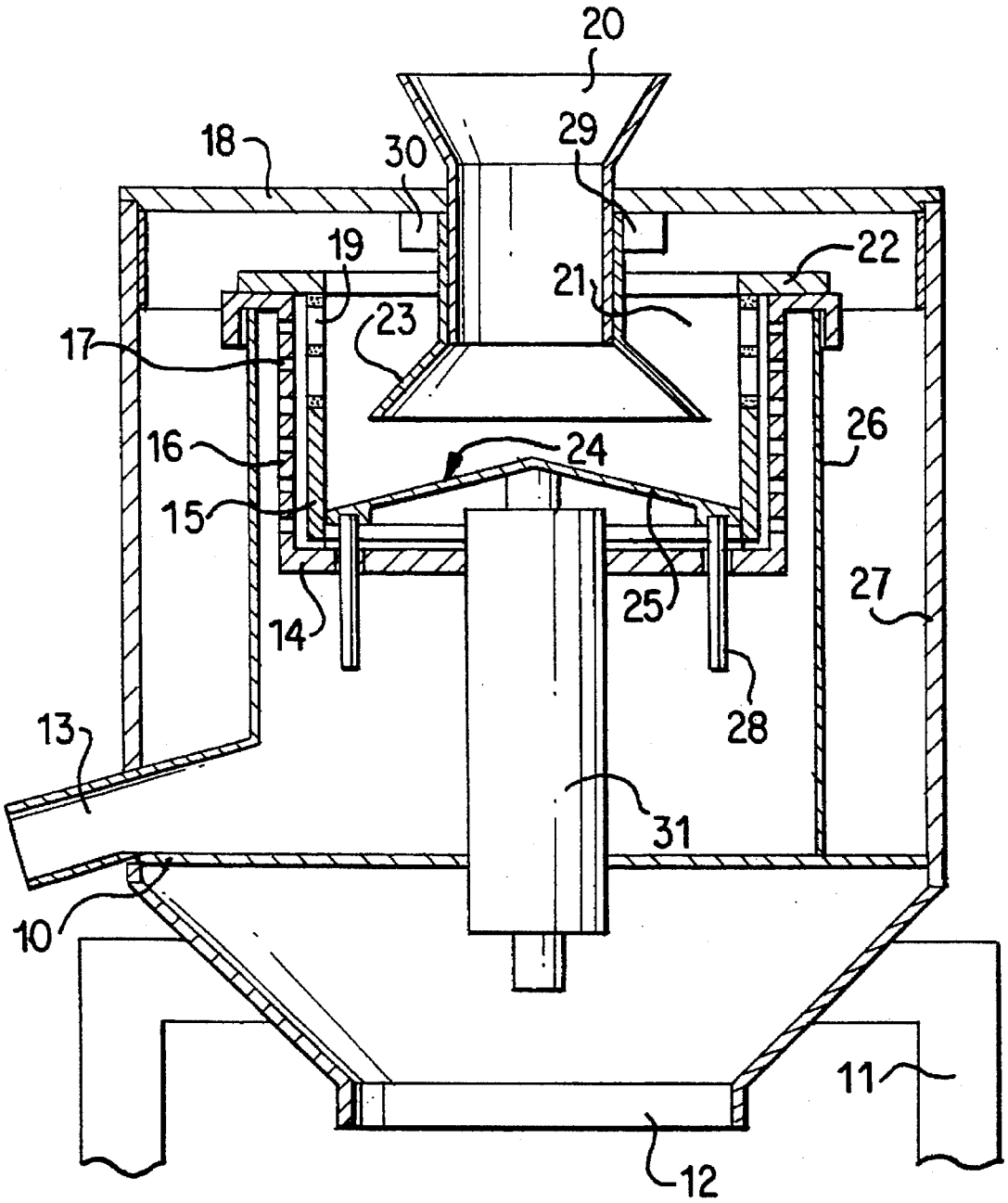
FIG. 1 shows a sectional view through a centrifuge according to the invention.

In FIG. 1, the machine frame 10 is illustrated and the stand is designated with reference numeral 11. A receptacle housing 27 is connected with the machine frame 10. The receptacle housing 27 can be closed at the top by means of a cover 18, through which only the inlet funnel 20 extends.

In the receiver housing 27, a liquid-tight basin or pan 26 is installed connected with the machine frame 10. Basin 26 is in communication with the outwardly extending liquid outlet 13. The rotationally driven receiving drum 21 is arranged in the liquid-tight basin 26. Receiving drum 21, is provided with a raisable and lowerable lift bottom 24, 25, which rotates with the receiving drum 21. The lift bottom 25 has a bottom surface 24 inclined outwardly at an angle from the center of the centrifuge. Lift bottom 25 also is guided in a manner shown in detail by means of guide rods 28 so as to be vertically displaceable relative to the floor 14 of the outer jacket 16 of the receiving drum 21. The receiving drum 21 is provided with a series of bore holes 17 in order to permit the liquid which has been shaken or spun loose to exit and pass into the liquid-tight basin 26.

Spaced from the outer jacket 16, the receiving drum 21 is provided with the lower shield jacket 15 and with the upper (inner) jacket portion 19. The lower shield jacket 15 is formed of a thick-walled material with a hard surface, while the upper jacket portion 19 is formed of gap sieves.

The materials introduced into the inlet funnel 20 are initially deposited in the center of the centrifuge and uniformly distributed in a radially outward direction, with the cooperation of the material guide surface 23. As a result of the effect of centrifugal force, the materials initially collect in the lower portion of the receiving drum 21, and as a result of the centrifugal force and of the material guide surface 23, are flung against the lower shield jacket 15, so that they collect there in the form of a ring and then are pushed upwardly by means of the periodically raised and lowered lift bottom 25. The lift bottom 25 is not connected with the material guide surface 23 and carries out a separate or independent raising and lowering movement or up and down movement.

The materials, which from then on lie uniformly annularly distributed adjacent the wall, are forced upwardly by the lift bottom 25 and pass into the region of the gap sieve in the upper jacket portion 19, where the liquid contained therein is spun or flung out and can exit through the openings 17 in the outer jacket 16 and pass into the liquid-tight basin 26, from where it flows out the liquid outlet 13.

The materials are moved further upwardly under the influence of centrifugal force and pass outwardly over the upper margin 22 of the receiving drum 21 in order to enter the intermediate space between the liquid-tight container 26 and the receiver housing 27. Subsequently, they fall downwardly and leave the centrifuge through the material outlet 12.

The drive of the material guide surface 23 is effected via drive devices 29, 30. The drive of the lift bottom 25 is effected via the drive device 31.

This drive device is, for example, an electromotor adjustable drive or a hydraulic drive. Naturally, it is possible to utilize any desired type of drive.

The material guide surface 23 and the lift bottom 25 can be controlled in parallel and thereby execute a common stroke; it is also possible to control the elements separately in order to enlarge or reduce the annular gap between these two elements.

Figure 2:
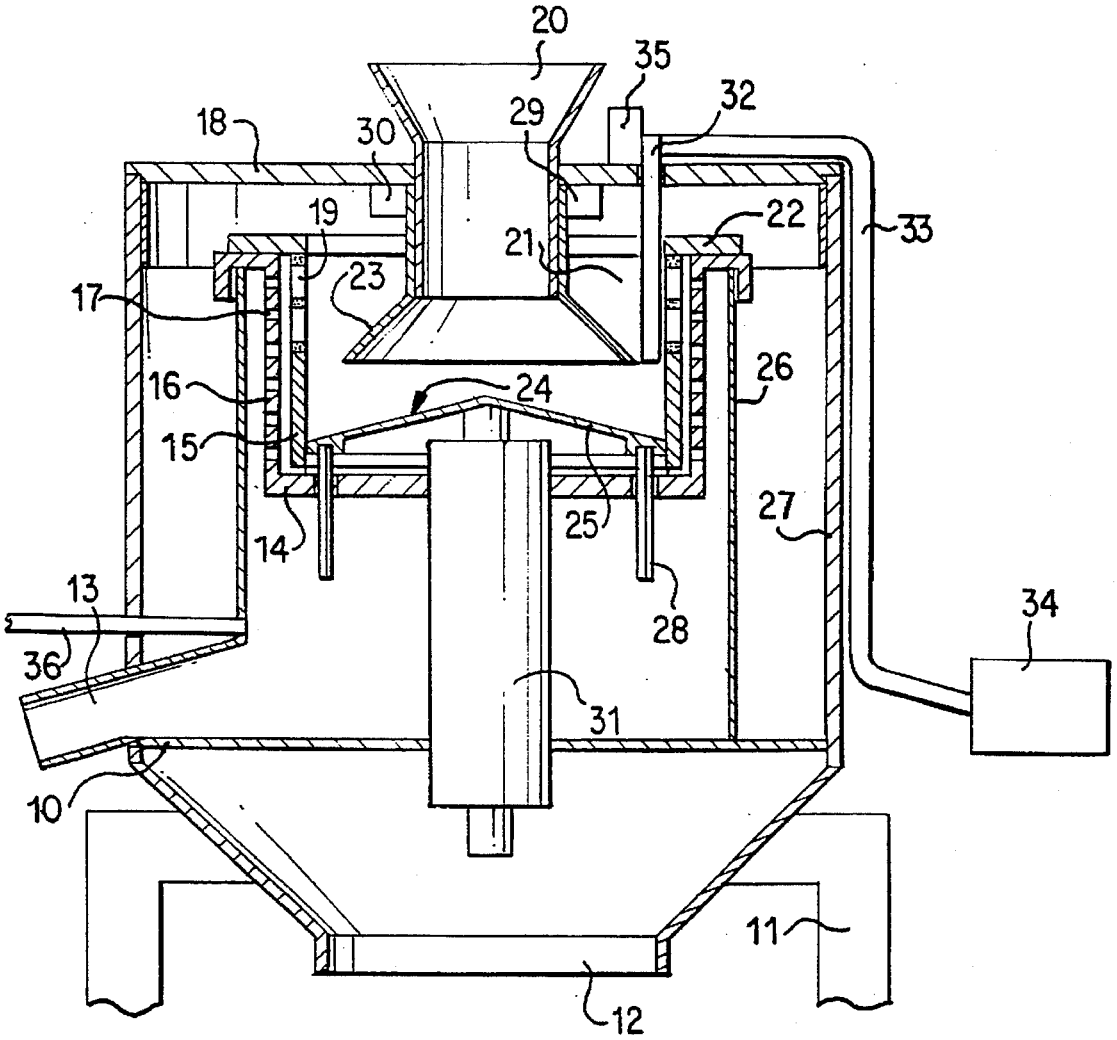
FIG. 2 shows a sectional view through a modified centrifuge embodiment according to the invention.

FIG. 2 shows a variant embodiment of the shavings centrifuge illustrated in FIG. 1. Similar parts are identified with the same reference numerals. In this variant, a vacuum for residual material is provided. This vacuum comprises a suction nozzle 32 which extends partially into the receiving drum. A suction line 33, which leads to suction blower 34, is arranged on the suction nozzle. In the suction blower, a separation of the solids from the blower air takes place. The suction nozzle is arranged so as to be longitudinally displaceable. The longitudinal displacement is effected via a drive 35.

A rinsing liquid inlet 36 is provided in order to rinse the basin 26. This inlet enters the basin tangentially and thus produces a stream of rinsing liquid which proceeds in the form of a spiral has a high rinsing effect.

Naturally, it is also possible to construct the entire shavings centrifuge, which is arranged upright in FIG. 1 and also in FIG. 2, in a lying down arrangement. For this purpose, the support 11 merely needs to be slightly modified.

Figure 3:
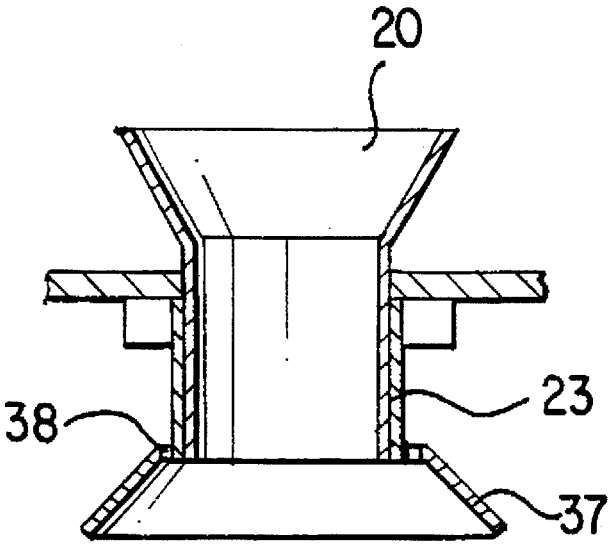
FIG. 3 shows a detailed illustration of a pivotally mounted distributor.

FIG. 3 shows a detailed illustration of the material inlet. At this material inlet, the inlet funnel 20 and the material guide surface 23 can be seen. Adjacent the material guide surface 23, a distributor 37 is provided. This distributor is rotatably connected via a ball bearing 38 with the material guide surface, which is shown here only as a cylinder.

In the metal processing industry, the centrifuge of the invention is particularly suitable to de-oil shavings from metalworking operations. This greatly facilitates the disposal of oily shavings which heretofore has been a major economic and environmental concern. The centrifuge of the invention enables an increased degree of recovery of lubricating and cooling oils over a long-term. The recovered oil can be recycled, and the de-oiled shavings, which typically contain less than 1% oil residue, can be sold. The operation may be fully automated and continuous. No cleaning of the receiving drum is required even when processing sludge. The centrifuge of the invention is highly dependable and quiet in operation. The centrifuge of the invention also requires a low amount of maintenance, and when service is required, the arrangement of its parts makes it easy to work on.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A shavings centrifuge for the separation of solids or liquids from various materials, said centrifuge comprising a liquid-tight basin in which a rotatable receiving drum is arranged, said receiving drum having a lift bottom and a material guide surface which are displaceable longitudinally of said receiving drum, wherein said lift bottom and said material guide surface are each independently displaceable of the other, and said lift bottom and said material guide surface are provided with drives which are separately controllable from each other.

2. A shavings centrifuge according to claim 1, wherein the lift bottom and the material guide surface are each provided with an independently operable electric drive.

3. A shavings centrifuge according to claim 1, wherein the lift bottom and the material guide surface are each provided with an independently operable pneumatic drive.

4. A shavings centrifuge according to claim 1, wherein the lift bottom and the material guide surface are each provided with an independently operable hydraulic drive.

5. A shavings centrifuge according to claim 1, wherein the lift bottom and the material guide surface are spaced-apart to define an annular gap between them, said gap having a variable gap width.

6. A shavings centrifuge according to claim 1, further comprising a vacuum apparatus having a suction nozzle which extends into the receiving drum.

7. A shavings centrifuge according to claim 6, wherein said suction nozzle is longitudinally movable into and out of the receiving drum.

8. A shavings centrifuge according to claim 1, further comprising a distributor disposed adjacent the material guide surface for distributing material introduced into the receiving drum.

9. A shavings centrifuge according to claim 8, wherein said distributor is rotatably attached to said material guide surface.

10. A shavings centrifuge according to claim 8, wherein said distributor is fixedly attached to said material guide surface.

11. A shavings centrifuge according to claim 1, wherein the receiving drum is provided with a sieve.

12. A shavings centrifuge according to claim 1, further comprising a rinsing liquid inlet on said basin.

13. A shavings centrifuge according to claim 12, wherein said rinsing liquid inlet enters the basin tangentially.

14. A shavings centrifuge according to claim 1, wherein said lift bottom is provided with a plurality of guide rods.

15. A shavings centrifuge according to claim 14, wherein said lift bottom is provided with at least three guide rods.

* * * * *